US005709014A

United States Patent [19]

Takahashi

[11] Patent Number: 5,709,014

[45] Date of Patent: Jan. 20, 1998

[54] THREE-WAY-STRAPPED BUCKLE

[75] Inventor: Yoshinobu Takahashi, Toyama-ken, Japan

[73] Assignee: YKK Corporation, Tokyo, Japan

[21] Appl. No.: 560,386

[22] Filed: Nov. 17, 1995

[30] Foreign Application Priority Data

Nov. 18, 1994 [JP] Japan ..... 6-309547

[51] Int. Cl.[6] ..... A44B 11/25

[52] U.S. Cl. ..... 24/614; 24/615

[58] Field of Search ..... 24/634, 637, 642, 24/194, 196, 632, 614, 615, 573.1, 573.5

[56] References Cited

U.S. PATENT DOCUMENTS

| | | | |
|---|---|---|---|
| 4,682,390 | 7/1987 | Parrish . | |
| 4,757,579 | 7/1988 | Nishino et al. . | |
| 4,802,262 | 2/1989 | Kasai | 24/615 X |
| 4,928,364 | 5/1990 | Ikeda | 24/615 X |
| 5,113,556 | 5/1992 | Murai et al. | 24/615 X |
| 5,533,240 | 7/1996 | Murai | 24/615 |
| 5,542,161 | 8/1996 | Anscher | 24/614 |
| 5,551,131 | 9/1996 | Anscher | 24/614 |

FOREIGN PATENT DOCUMENTS

| | | |
|---|---|---|
| 0309943 | 5/1989 | European Pat. Off. . |
| 1298012 | 11/1962 | France . |
| 07246106 | 9/1995 | Japan . |
| 676316 | 1/1991 | Switzerland . |
| 1 371 152 | 10/1974 | United Kingdom . |

*Primary Examiner*—Peter M. Cuomo
*Assistant Examiner*—Stephen Vu

[57] ABSTRACT

A buckle comprising first and second plugs, each attached to one end of a respective one of first and second straps, and a socket attached to one end of a third strap. Each plug has at its base a first or second strap attaching portion, a first or second tongue projecting from the first or second strap attaching portion and terminating in a first or second engaging end and to be inserted into the socket. The socket has longitudinal first and second insertion holes formed so as to communicate and confront with each other for receiving the tongues of the first and second plugs, first and second fixed engaging portions projecting in the insertion holes respectively for engagement with the respective engaging ends of the tongues of the plugs, and a release button formed between the first and second fixed engaging portions for depressing the engaging ends respectively to deform and release them from the fixed engaging portions.

15 Claims, 6 Drawing Sheets

THREE-WAY-STRAPPED BUCKLE

BACKGROUND OF THE INVENTION

1. Field of the Invention

This invention relates to a three-way-strapped buckle for use, for example, in holding a human body.

2. Description of the Related Art

A conventional three-way-strapped buckle, as disclosed in U.S. Pat. No. 4,457,052, comprises a pair of hasps, and a buckle into which the hasps are to be inserted, each of the hasps having a hasp tip to be inserted, which projects from a base of the hasp and has a slot as an engaging portion. The buckle has a pair of bosses formed on a plate for engagement with the engaging portion. The plate is normally urged in a direction of engagement by a spring and is adapted to be depressed in a direction of release by a push button.

In operation, firstly the hasps are inserted into the buckle until the boss comes into engagement with the slot of the hasp tip of one hasp. During that time, the hasp tip pushes down the boss against the spring until the slot of the hasp tip is aligned with the boss, whereupon the boss comes into engagement with the slot of the hasp tip. Likewise the other plug is inserted into the buckle until the catch come into engagement with the slot of the hasp tip. For removing the hasps from the buckle, the push button of the buckle is depressed to allow the pair of bosses on the single plate to come off the slots of the hasp tips simultaneously, thus removing a pair of hasps simultaneously.

In the foregoing conventional art, a pair of catches is retracted as a unit in a direction of release; consequently, if the two hasps are inserted into the buckle one after the other, the boss engaged with the first-inserted hasp will be retracted again upon insertion of the second-inserted hasp. As a result, the first-inserted hasp will come out of engagement. Yet it is rather difficult to insert the pair of hasps simultaneously into the buckle, which is poor in operation.

SUMMARY OF THE INVENTION

It is therefore an object of this invention to provide a buckle which is simple in structure, good in operation during attaching and removing and is reliable in coupling between socket and plugs.

According to this invention, there is provided a buckle comprising: first and second plugs each attached to one end of a respective one of first and second straps; and a socket attached to one end of a third strap; each of the plugs having at each base thereof a first or second strap attaching portion, a first or second tongue projecting from the first and second strap attaching portions respectively and terminating in a first or second engaging end respectively and to be inserted into the socket; the socket having first and second longitudinal insertion holes formed so as to communicate sad confront with each other for receiving the first and second tongues of the first and second plugs, first and second fixed engaging portions projecting in the first and second insertion holes respectively for engagement with the respective first and second engaging ends of the tongues of the plugs, and a release button formed between the first and second fixed engaging portions for depressing the first and second engaging ends respectively to deform and release them from the fixed engaging portions.

Preferably, the respective first and second plugs have first and second support strips to be received, together with the first and second tongues, in the insertion holes of the socket respectively, either of the first and second tongues or the first and second support strips being adapted to be resiliently deformable in response to the depressing action of the release button. Further, the respective first and second fixed engaging portions of the socket are located on opposite sides of the release button and arranged in a staggered and confronting relationship with each other. Each of the first and second fixed engaging portions may be plural and arranged in a staggered and confronting relationship without overlapping one another in a direction of insertion of the tongues. The release button is composed of a button body exposed on a front-wall surface of the socket, a push projection formed integrally on a back-wall surface of the button body, and a resilient member projecting integrally from the button body and extending integrally from the end into the inside of the socket. The socket has a guide in the first and second insertion holes for restricting a direction of insertion of the plugs, and each plug has a slide slidable on and along the guide.

With the buckle of this invention, since the fixed engaging portions are integrally formed with the socket, the respective engaging ends of the tongues or support strips of the plugs climb over and come into engagement with the respective fixed engaging portions as the tongues or support strips flex during insertion of the plugs into the socket. For removing the plugs from the socket, the release button is depressed so that the push projection pushes down the engaging ends of each of the tongues to a release position. As a result, the individual plugs have been simultaneously released off the socket.

DETAILED DESCRIPTION OF THE PREFERRED EMBODIMENT

Figure 1:
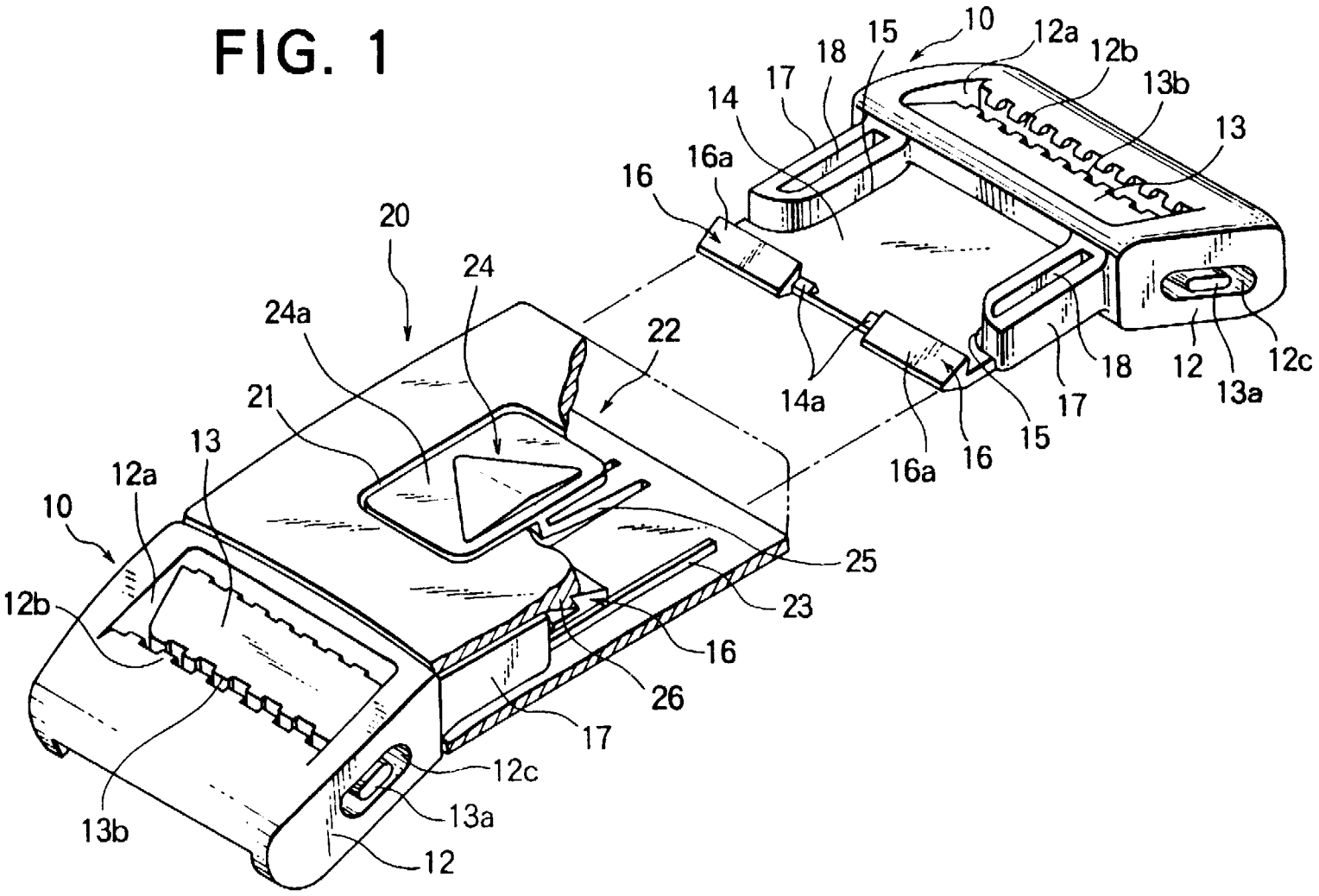
FIG. 1 is a perspective view, with partly broken away, of a buckle according to an embodiment of this invention.
Figure 2:
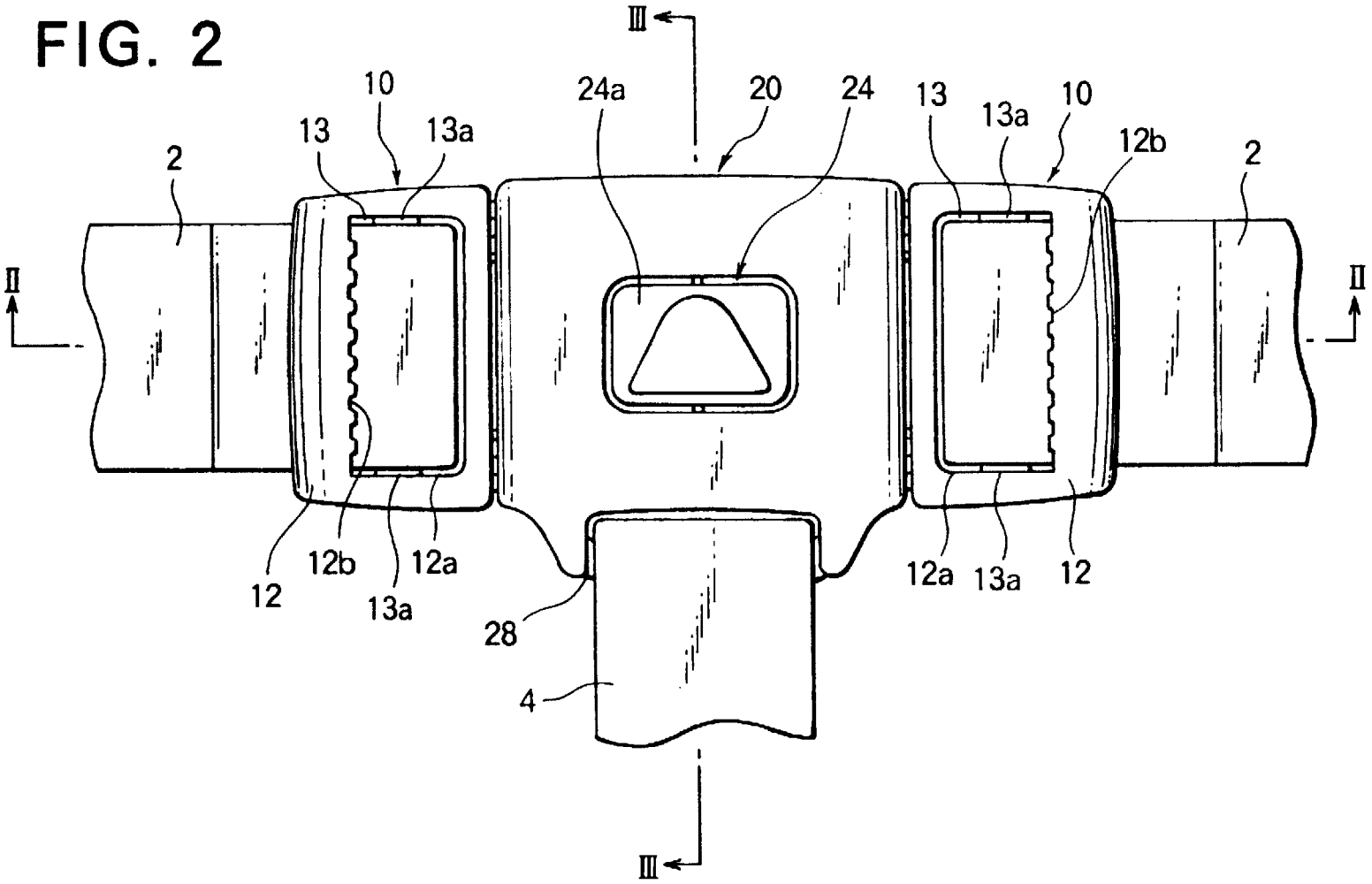
FIG. 2 is a plan view of the buckle of FIG. 1, showing a pair of plugs in engagement with a socket.

A preferred embodiment of this invention will now be described with reference to the accompanying drawings. The buckle of this embodiment is a three-way-strapped buckle suitable for use as a seat belt of a vehicle or a holder for a human body and, as shown in FIG. 2, comprises first and second plugs 10 of synthetic resin to be attached to one end of each of first and second straps 2, and a socket 20 of synthetic resin which is to be attached to a third strap 4 and into which each plug 10 is to be inserted for engagement. As shown in FIG. 1, each of the plugs 10 has a first or second plate-like tongue 14 projecting from a first or second strap-attaching portion 12 formed at the base of each of the plugs 10, and first or second pair of support strips 17 integrally formed on and projecting from the strap-attaching portion 12 along opposite side cutouts 15 of the tongue 14. The tongue 14 has on its front surface of a pair of engaging ends 16, each having an upper surface 16a sloping down in a plug-insertion direction and an engaging surface 16b (FIG. 3) contiguous to the upper surface 16a and formed on a side toward the base of the tongue 14. The pair of engaging ends 16 of the tongue 14 have on their confronting inner sides a pair of bulges 14a smaller in size than the engaging ends 16. Each of the pair of the bulges 14a is in the form of a wedge having an inclined surface sloping down to the end of the tongue 14.

Figure 6:
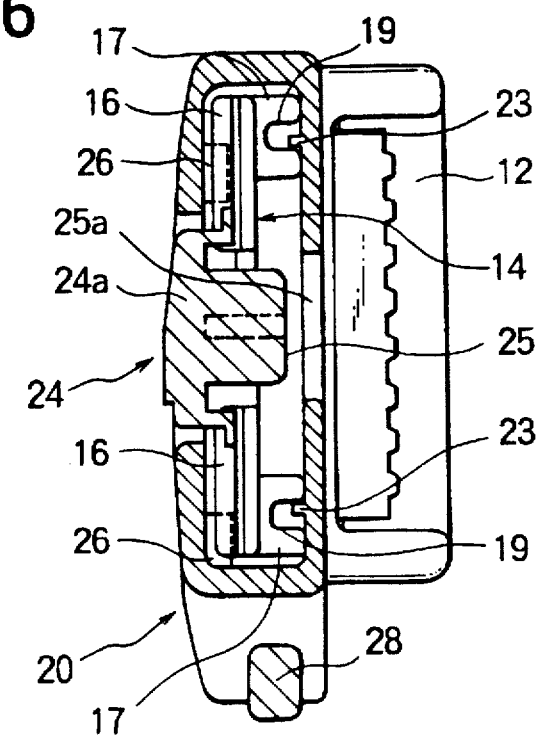
FIG. 6 is a cross-sectional view taken along line III—III of FIG. 2.

Each of the pair of the support strips 17 formed on the sides of the first or second tongue 14 has a central longitudinal slit 18 and is substantially equal in width, which is perpendicular to the direction of insertion of the support strip 17, to the width of an insertion hole 22 of the socket 20. Each of the pair of the support strips 17 has on its back surface a longitudinal groove 19 (FIG. 6) to be guided as a slide toward the socket 20 in a manner described below during insertion. On the back surface of the base of each of the tongues 14, there is a pair of triangular reinforcing ribs 14c (FIG. 3) spaced apart toward opposite sides of the tongue 14 along the border between the base of the tongue 14 and the strap-attaching portion 12.

Figure 3:
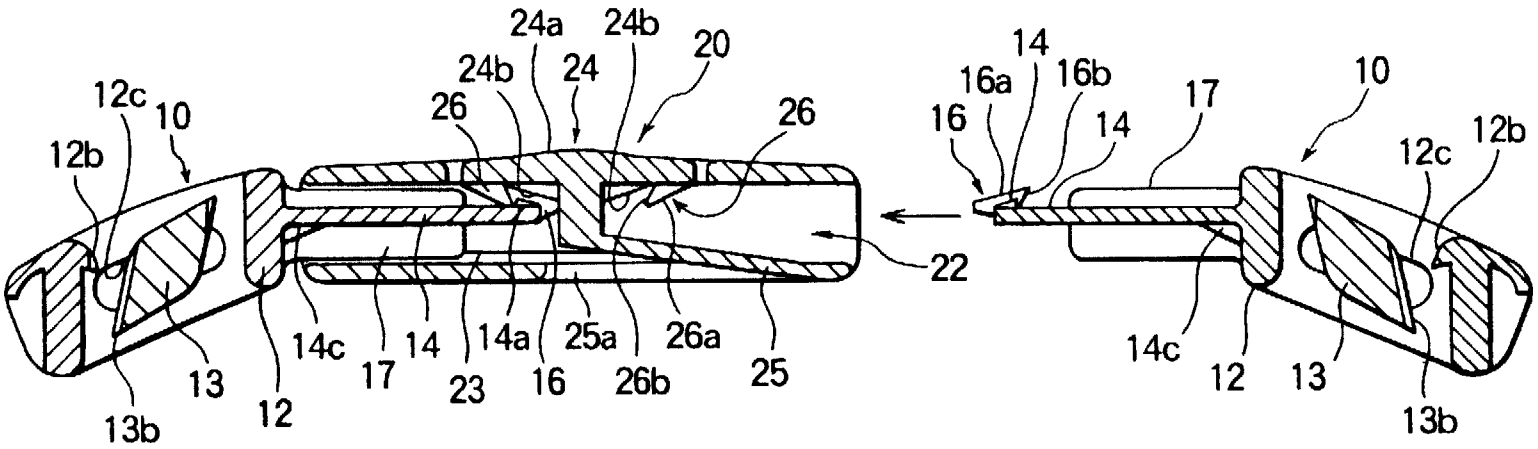
FIG. 3 is a cross-sectional view taken along line II—II of FIG. 2, showing one of the plugs as removed off the socket.
Figure 4:
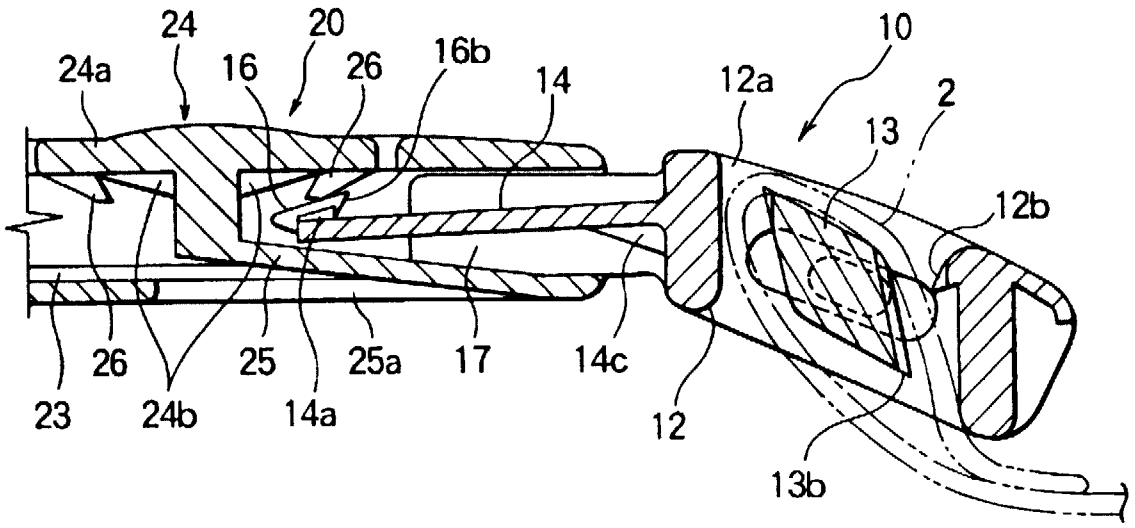
FIG. 4 is a fragmentary, enlarged cross-sectional view taken along line II—II of FIG. 2, showing the plugs as inserted into the socket.
Figure 5:
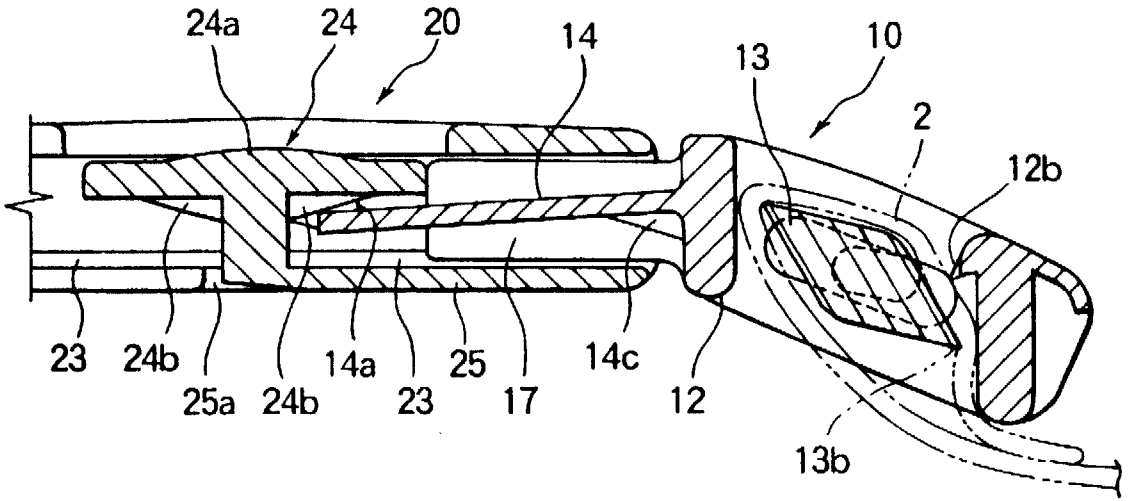
FIG. 5 is a fragmentary, enlarged cross-sectional view taken along line II—II of FIG. 2, showing the plugs in engagement with the socket.

The strap-attaching portion 12 of the respective plug 10 is inclined by 23 toward the back-wall side of the socket 20, with respect to the strap 2. The strap-attaching portion 12 of each plug 10, as shown in FIGS. 3 through 5, an attachment hole 12a through which an end portion of the strap 2 is threaded, and a clamping member 13 pivotable and reciprocatingly slidable within a predetermined range in the attachment hole 12a. The clamping member 13 has opposite ends 13a which are loosely received one in each of a pair of slots 12c formed in opposite side surfaces of the strap-attaching portion 12. Each end 13a of the clamping member 13 has a size such as to be reciprocatingly movable within the respective slot 12c and has an elliptic cross-sectional shape. The strap-attaching hole 12a has at its end toward the strap 2 a strap-side serrated edge 12b. The clamping member 13 also has at its end a similar serrated edge 13b confronting with the strap-side serrated edge 12b. The clamping member 13 has, as shown in FIGS. 3 through 5, a rhombic cross-sectional shape such that an acute edge of the rhombus is contactable with the inside surface of the strap-attaching hole 12a.

As shown in FIG. 1, the socket 20 has first and second insertion holes 22 in the form of a flat tube into which the first and second plugs 10 are to be inserted respectively, and has on the inside surface of the back-wall a pair of guide ridges 23 for guiding the first and second plugs 10. The socket 20 has at its center a release button 24 that includes a button body 24a located in an aperture 21 of a front-wall surface of the socket 20 and exposed on the front-wall surface, and two confronting pairs of push projections 24b (FIG. 3) integrally formed on a back surface of the button body 24a for pushing the tongues 14 of the two plugs 10 downwardly. Each pair of the push projections 24b is engageable with the bulges 14a of the tongues 14 of the plugs 10, and each of the push projections 24b has an inclined slope engageable with the inclined surface of the respective bulge 14a. The release button 24 additionally has a resilient member 25 integrally extending from the back surface of the button body in the insertion hole 22 between the back-wall surface of the socket 20 into the inside of the insertion hole 22 and extending from the inlet to the inside of the insertion hole 22. The socket 20 has in the backside surface a through hole 25a so that the resilient member 25 can be pivotally moved in response to the depression of the release button 24.

Figure 7:
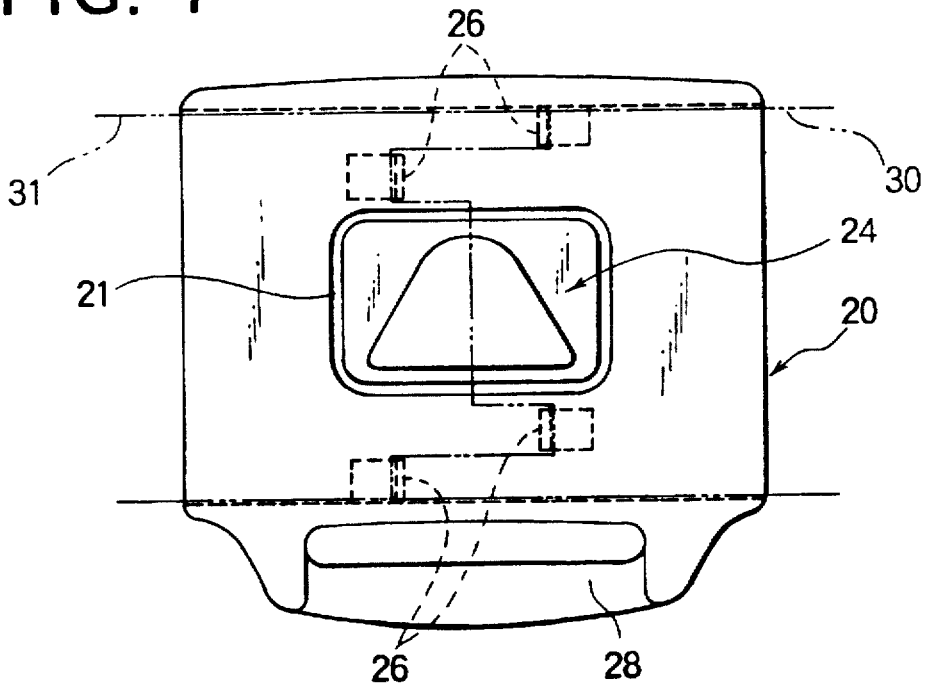
FIG. 7 is a plan view showing the socket as molded.

On the inside surface of the insertion hole 22, there are formed first and second pairs of engaging portions 26 engageable with the respective first and second pairs of engaging ends 16 of the plugs 10, which project into the insertion hole 22 of the socket 20 in a staggered and confronting relationship. The engaging portions 26 are fixed to the socket 20 in the insertion hole 22 and, as shown in FIG. 7, they are arranged in a staggered manner as viewed in the direction of insertion of the plugs 10 so as not to overlap each other. Each of the pairs of the engaging portions 26 has an inclined surface 26a sloping toward the back wall of the socket 20 in the direction of insertion of the plugs 10 so as to match the shape of the upper surface 16a of the engaging end 16. Further, each engaging portion 26 has an engaging surface 26b inclined slightly from a plane perpendicular to the direction of insertion of the plugs 10 so as to match the shape of the engaging surface 16b of the engaging end 16. The socket 20 has on one side surface thereof a strap-attaching portion 28 which extends in another direction perpendicular to the direction of insertion of the plugs 10 and to which the second strap 4 is to be attached.

The method of manufacturing the buckle of this embodiment will now be described. Firstly, each of the plugs 10 and each of the clamping members 13 are molded simultaneously by a known injection molding method. A slide core is located between the slot 12c on each side and each end 13a of the clamping member 13 during molding so that the clamping member 13 can be separated from the plug 10. The socket 20 is also molded by a known injection molding method, during which, as shown in FIG. 7, a pair of slide cores 30, 31 forms opposite end openings of the insertion holes 22 and also form the pairs of the first and second engaging portions 26 by their inner ends. At that time, since the pairs of the engaging portions 26 are arranged in a staggered manner as viewed in the direction of sliding of the slide cores 30, 31 for molding the respective insertion holes 22, the engaging portions 26 projecting into the insertion hole 22 can be formed simply by sliding the slide cores 30, 31 in opposite directions as viewed in FIG. 7. Thus it is possible to form the engaging portions 26 easily using a simple mold.

The way to use the buckle of this embodiment will now be described below. For connecting each of the plugs 10 with the socket 20, firstly the tongue 14 are inserted into the insertion hole 22 as shown in FIG. 3. At that time, the tongue 14 is inserted smoothly as the longitudinal grooves 19 formed on the back side of the support strips 17 are guided by the guide ridges 23 of the insertion hole 22 until the engaging ends 16 of the tongue 1 come into contact with the engaging portions 26. With continued insertion of each plug 10 into the socket 20, the upper surfaces 16a of the engaging ends 16 are pushed downwardly along the inclined surfaces 26a of the engaging portions 26 as shown in FIG, 4. Further insertion makes the engaging ends 4 to climb over the engaging portions 26 and, as a result, the engaging surfaces 16a, 26a are brought into contact with each other. Since the engaging ends 16 are resiliently bent with respect to the engaging portions 26, it is possible to connect the plugs 10 with the socket 20 individually and reliably.

For releasing the plugs 10 off from the socket 20, the button body 24a of the release button 24 is depressed to push the bulges 14a of the tongues 14 by the push projections 24b as shown in FIG. 5 so that the tongues 14 are resiliently bent toward the back side. Since the inclined surfaces of the push projections 24b are resiliently pressed in contact with the inclined surfaces of the bulges 14a, forces are exerted on the plugs 10 so as to push the plugs 10 out of the insertion hole 22 so that the engaging ends 16 are removed from the engaging portions 26, thus pushing the plugs 10 out of the socket 20. Since the push projections 24b are adapted to be located in confronting relationship with the respective bulges 14a of the tongues 14, the plugs 10 are simultaneously released out of engagement with the socket 20 and are pushed outwardly by depressing the button body 24a.

The first or second strap 2 attached to each plug 10 of this embodiment is wound around the clamping member 13 and is reliably held between the attachment hole 12a of the first or second strap-attaching portion 12 and the clamping member 13, as shown in FIG. 4. At that time, as shown in FIG. 5, if the base side of the strap 2 is pulled, an anticlockwise moment as viewed in FIG. 5 is exerted on the clamping member 13 so that the acute corner of the clamping member 13 is pressed against the inside wall surface of the attachment hole 12a as the serrated edges 12b, 13a clamp the strap 2 by the above-mentioned moment, thus holding the strap 2 reliably. Even if the strap 2 is pulled toward the back side off the strap-extending direction of the strap-attaching portion 12, a force acts on the clamping member 13 by the tension of the strap 2 in such a direction that the strap 2 is clamped between the clamping member 13 and the strap-side edge of the attachment hole 12a, thereby preventing the strap 2 from being removed off from the socket 20.

According to the buckle of this embodiment, it is possible to connect two plugs 10 individually with the socket 20 and to release the two plugs 10 simultaneously from the socket 20 by depressing the release button 24. Since the release button 24 is formed centrally of and integrally with the socket 20, the buckle is easy to manufacture, and reliable connection can be achieved. Since the resilient member 25 extends toward the center of the insertion hole 22, it is possible to prevent the resilient member 25 from projecting from the surface of the back-wall of the socket 20, even when the release button 24 is depressed, so that the user of the buckle would not get an unpleasant touch when releasing.

The buckle of this invention should by no means be limited to the illustrated embodiment. The tongue 14 may be rigid with respect to the strap-attaching portion 12 while the support strips 17 may be resilient, so that the support strips 17 can resiliently deform so as to make the plug 10 pivotally move when the plug 10 is inserted into the socket 20. The shapes of the release button 24, the engaging ends 16 and the engaging portions 26 may be shaped as desired, and the shapes of the tongue 14 and the clamping member 13 also should not be limited to the illustrated embodiment.

With the buckle of this invention, the individual plugs 10 can be inserted independently into the socket 20. And the two plugs 10 can be released simultaneously off the socket 20 simply by depressing the release button 24. Since the plugs 10 can be released by the resilient deformation of the plugs 10, it is possible to connect the individual plugs 10 independently and reliably with the socket 20. Since the engaging portions 26 of the socket 20 may be arranged in a staggered manner, they can be engaged with the engaging ends 16 reliably, and the socket 20 can be molded in a simple method. Further, the release button 24 can be moved by the resilient member 25 integral with the socket 20 to release the two tongues 14 off the insertion hole 22 of the socket 20 easily and reliably.

What is claimed is:

1. A buckle comprising:

(a) first and second plugs each attached to one end of a respective one of first and second straps; and (b) a socket attached to one end of a third strap;

(c) each of said plugs having at each base thereof a first or second strap attaching portion, a first or second tongue projecting from said respective strap attaching portion and said first or second tongue terminating in first or second engaging ends respectively to be inserted into said socket;

(d) said socket having at opposite ends longitudinal first and second insertion holes formed so as to communicate and confront with each other for receiving said first and second tongues of said plugs, said socket having first and second fixed engaging portions projecting into said first and second insertion holes respectively for engagement with the first and second engaging ends respectively of said tongues of said plugs, and said socket having a release button formed between said first and second fixed engaging portions for depressing said first and second engaging ends respectively to deform and release them from said fixed engaging portions, said first and second tongues having bulge portions with inclined surfaces and said release button having push projections with oblique surfaces facing said inclined surfaces, depression of said release button causing said oblique surfaces to press said inclined surfaces to deflect said tongue to release engagement from said fixed engaging portions.

2. A buckle according to claim 1, wherein said respective first and second plugs have first and second support strips to be received, together with said first and second tongues, in said first and second insertion holes of said socket, either of said first and second tongues or said respective support strips being adapted to be resiliently deformable in response to the depressing action of said release button.

3. A buckle according to claim 2, wherein said first and second fixed engaging portions of said socket are located on opposite sides of said release button respectively and arranged in a staggered and confronting relationship with each other.

4. A buckle according to claim 3, wherein each of said first and second fixed engaging portions are plural and arranged in a staggered and confronting relationship without overlapping one another in a direction of insertion of said tongues.

5. A buckle according to claim 1, wherein said first and second fixed engaging portions of said socket are located on opposite sides of said release button respectively and arranged in a staggered and confronting relationship with each other.

6. A buckle according to claim 5, wherein each of said first and second fixed engaging portions are plural and arranged in a staggered and confronting relationship without overlapping one another in a direction of insertion of said tongues.

7. A buckle according to claim 1, wherein said release button is composed of a button body exposed on a front-wall surface of said socket, a push projection formed integrally on a back surface of said button body, and a resilient member projecting integrally from said button body and extending integrally from said button body to a fixed wall of said socket.

8. A buckle according to claim 1, wherein said socket has a guide extending in said first and second insertion holes for restricting a direction of insertion of said front and second plugs, and each said plug has a slide slidable on and along said guide.

9. A buckle according to claim 1, wherein each of said engaging ends comprises two spaced apart engaging parts, and said bulge portions comprising two wedges between said two engaging parts.

10. A buckle according to claim 9, wherein each of said engaging parts comprises an inclined guide surface for pressing said fixed engaging portions during insertion to deflect said tongues, and an engagement surface angled from said guide surface for engagement with one of said fixed engaging portions.

11. A buckle comprising:

first and second plugs each attached to one end of a respective one of first and second straps;

a socket attached to one end of a third strap;

each of said first and second plugs having at each base thereof a first and second strap attaching portion respectively, a first and second tongue projecting from said respective strap attaching portion respectively, and said first and second tongue respectively terminating in first and second engaging ends to be inserted into said socket;

said socket having at opposite ends longitudinal first and second insertion holes formed so as to communicate and confront with each other for receiving said first and second tongues of said plugs, said socket having first and second fixed engaging portions projecting into said first and second insertion holes respectively for engagement with the first and second engaging ends respectively of said tongues of said plugs, each of said first and second engaging ends comprising two spaced apart engaging surfaces, said socket having a release button formed longitudinally between said first and second fixed engaging portions for depressing said first and second engaging ends respectively to deflect and release said engaging surfaces from said fixed engaging portions, and said socket having a guide extending in said first and second insertion holes for restricting a direction of insertion of said first and second plugs, and wherein each said plug has a slide slidable on and along said guide.

12. A buckle according to claim 11, wherein said first and second fixed engaging portions are staggered transversely of said socket so as to not to align longitudinally.

13. A buckle according to claim 11, wherein said release button is composed of a button body exposed on a front-wall surface of said socket, a push projection formed integrally on a back surface of said button body, and a resilient member projecting integrally from said button body and extending integrally from said button body to a fixed wall of said socket.

14. A buckle according to claim 11, wherein said respective first and second plugs have first and second support strips to be received, together with said first and second tongues, in said first and second insertion holes of said socket, said first and second tongues being adapted to be resiliently deformable in response to the depressing action of said release button.

15. A buckle according to claim 11, wherein said first and second plugs each comprise a flat plate and each of said engaging ends comprises two guide surfaces extending obliquely up from said flat plate and each of said engaging surfaces angled obliquely from one of said guide surfaces to said plate.

* * * * *